United States Patent [19]

Ohashi et al.

[11] Patent Number: 4,994,855

[45] Date of Patent: Feb. 19, 1991

[54] ELECTROPHOTOGRAPHIC IMAGE FORMATION APPARATUS WITH TWO BIAS VOLTAGE SOURCES

[75] Inventors: Kunio Ohashi; Yoshikazy Fujiwara; Shiro Narikawa; Shoichi Nagata, all of Nara; Kazuki Wakita, Osaka; Takashi Hayakawa, Nara, all of Japan

[73] Assignee: Sharp Kabushiki Kaisha, Osaka, Japan

[21] Appl. No.: 199,127

[22] Filed: May 26, 1988

[30] Foreign Application Priority Data

| | | | |
|---|---|---|---|
| May 28, 1987 | [JP] | Japan | 62-133105 |
| May 28, 1987 | [JP] | Japan | 62-133106 |
| May 28, 1987 | [JP] | Japan | 62-133107 |
| Jul. 25, 1987 | [JP] | Japan | 62-185767 |
| Jul. 25, 1987 | [JP] | Japan | 62-185768 |
| Jul. 25, 1987 | [JP] | Japan | 62-185769 |
| Dec. 9, 1987 | [JP] | Japan | 62-311337 |

[51] Int. Cl.[5] ..... G03G 5/00; G03G 15/18; G03G 21/00

[52] U.S. Cl. ..... 355/211; 355/217; 355/219; 355/271

[58] Field of Search ..... 355/210, 217, 272, 219, 355/271, 273, 211; 430/57

[56] References Cited

U.S. PATENT DOCUMENTS

| | | | |
|---|---|---|---|
| 3,630,608 | 12/1971 | Sage | 355/217 X |
| 3,784,300 | 1/1974 | Hudson et al. | 355/273 |
| 3,918,971 | 11/1975 | Zweig | 355/272 X |
| 4,142,792 | 3/1979 | Satomi et al. | 355/272 X |
| 4,408,864 | 10/1983 | Hardenbrook | 355/217 |
| 4,465,750 | 8/1984 | Ogawa et al. | 430/57 |
| 4,607,934 | 8/1986 | Kohyama et al. | 355/210 |
| 4,818,651 | 4/1989 | Shirai et al. | 430/57 |
| 4,818,652 | 4/1989 | Shirai et al. | 430/57 |

FOREIGN PATENT DOCUMENTS

| | | | |
|---|---|---|---|
| 54-119931 | 9/1979 | Japan | 355/272 |

*Primary Examiner*—Fred L. Braun

*Attorney, Agent, or Firm*—Flehr, Hohbach, Test, Albritton & Herbert

[57] ABSTRACT

A photoreceptor for an image formation apparatus has a photosensitive layer of a multi-layer structure each having the characteristic of increasing its electrical resistance at a different rate upon expose to light. An image-carrying beam of reflected light from an original to be copied is made incident on the photoreceptor to form a resistance image. An electrostatic latent image is formed therefrom either on the photoreceptor itself or on a transfer medium placed in contact therewith and a visible toner image is formed by applying toner on such an electrostatic image but the resistance image on the photoreceptor remains undisturbed during such image transfer processes. Thus, a plurality of copies of a single original can be produced without exposing the photoreceptor to reflected light therefrom for each copy to be printed.

6 Claims, 11 Drawing Sheets

ELECTROPHOTOGRAPHIC IMAGE FORMATION APPARATUS WITH TWO BIAS VOLTAGE SOURCES

BACKGROUND OF THE INVENTION

This invention relates to electrophotographic apparatus for forming an image, for example, for obtaining a copy of an original pictorial image. More particularly, the present invention relates to improvements in such apparatus which use an amorphous silicon photoreceptor such that generation of ozone and nitrogen oxides can be prevented, the active life of the photoreceptor can be increased and an image with high contrast can be obtained even with light of low intensity.

In copiers and other electrophotographic image forming apparatus, it has been known to make use of a photoreceptor with photoconductive characteristics whereby electrical resistance is reduced on areas exposed to light with such an apparatus, the photoreceptor is preliminarily charged electrostatically and if its surface is exposed to light reflected, for example, from an original document to be copied, electroconductivity results in areas where light intensity is high such as those corresponding to a white, or unprinted, area on the original document. Electrical charges in these areas are thereby cancelled and there results an electrostatic latent image. If toner is electrostatically attached to this electrostatic latent image and if the attached toner is transferred to a sheet of transfer paper, a visible image of the original document can be obtained. After the transfer process, the photoreceptor is cleaned by a cleaner and a similar series of processes is repeated to form another image. For charging the photoreceptor electrostatically, use is commonly made of a corona discharger. Methods of charging it by means of a charged brush or a charged roller have been proposed but since the electrical resistance of the photoreceptor is low, it is nearly impossible to uniformly charge it by such means and the use of a corona discharge is currently the only practically accepted method.

Speed of the image formation process described above is largely dependent upon the step of exposing the photoreceptor to light reflected from the original document. It is because a certain minimum amount of light energy must be absorbed by the photoreceptor before its surface becomes partly conductive but since there is a limit to which the light intensity can be increased, the time of light exposure must be made long enough for the photoreceptor to absorb the necessary amount of light energy. Since the original document must be exposed to light each time a copy is to be made, it is time-consuming by a conventional image formation method to obtain a large number of copies.

Recently, Japanese Patent Publication Tokkai 58-70238 disclosed a new image formation method by using a photosensitive body having the characteristic of increasing resistance when exposed to light. In the case of amorphous silicon, such characteristic of increasing resistance is known as the Stebler-Ronsky effect and a prior art image forming apparatus and method by using this effect is schematically shown in FIG. 1 wherein numeral 91 indicates a photoreceptor having a photosensitive layer 81 formed on an electroconductive drum 82. Numeral 92 symbolically indicates an optical system for causing a light beam with sufficient energy to fall upon the photoreceptor 91 and to thereby change its electrical resistance locally. An image of an original document to be copied (not shown), for example, is thereby formed on the surface of the photoreceptor 91 by the change of its resistance. Such an image will be referred to as a resistance image in order to distinguish it from images of other latent or visible types.

With reference still to FIG. 1, the photoreceptor 91 keeps rotating in the direction of the arrow and numeral 93 indicates a corona discharger for charging the photoreceptor surface by a corona discharge. When there is a corona discharge, charge is retained only where light has been made incident by the optical system 92 and the photoreceptor surface has increased resistance, thereby converting the aforementioned resistance image into an electrostatic image. Thereafter, toner is attached to this latent electrostatic image by a developing device 94 as done in the conventional electrophotographic process and a visible toner image is formed on the photoreceptor 91. Thereafter, this toner image is transferred onto a transfer medium 83 such as a sheet of transfer paper by means of a transfer charger 95 in a manner well known in electrophotography. Since the resistance image still remains on the photoreceptor surface after the transfer of toner image as described above, another electrostatic latent image can be formed thereon if static charge is again attached thereonto by another corona discharge by the charger 93. In other words, another copy of the same original can be produced without exposing the original to light again. In general, any number of copies of the same original can be obtained after exposing the original to light once. This has the favorable consequence of speeding up the process of obtaining many copies of a single original. In FIG. 1, numeral 96 indicates a charge removing discharger for removing the charge on the photoreceptor surface and numeral 97 indicates a toner cleaner for removing residual toner remaining unused on the aforementioned photosensitive layer 81. The resistance image is erased, if so desired, by heating the photoreceptor 91 to about 150°-200° C. by means of a heater 98 and an infrared lamp 99.

Conventional image formation methods and apparatus have many disadvantages and drawbacks. Firstly, as described above, some toner inevitably remains on the photoreceptor surface after the toner image is transferred and a cleaning process must be included to remove the residual toner. Since the toner transfer efficiency is generally about 70–80%, this means that as much as 20–30% of the developed toner is not utilized, collected in the cleaning process and eventually discarded. From the economical point of view, too, it is very wasteful. If the cleaning process is dispensed with, however, a so-called ghost may appear in the next image forming cycle due to the toner remaining on the photoreceptor surface. Moreover, if the photoreceptor is operated continuously over a long period of time, the residual toner may melt as a result of stress thereon such as heat, forming a thin film of toner on the photosensitive layer and thereby adversely affecting the quality of produced image with reduced image density, etc. In order to avoid such undesirable consequence, a maintenance work will be frequently required for removing the thin toner film on the photosensitive layer. A cleaning blade or a fur brush is frequently used for removing the residual toner but their use tends to injure or disfigure the photoreceptor surface.

Secondly, the corona discharge by the charger not only serves to uniformly charge the photoreceptor as desired but also causes ozone and nitrogen oxides to be formed from oxygen and nitrogen in air. Such ozone and nitrogen oxides, if they come into contact with the photoreceptor surface, tend to oxidize it and/or absorb moisture in air, thereby forming a thin oxide film on the photoreceptor surface. Since such an oxide film has low electrical resistance and is hardly capable of holding electrical charges, it has the undesirable effect of disturbing the electrostatic latent image formed on the photoreceptor surface and hence producing a foggy image. Moreover, generation of ozone itself is undesirable from the point of view of environmental pollution.

Thirdly, there has been a problem of contrast. Conventional photoreceptors for forming a resistance image are structured as shown in FIG. 2 with an amorphous silicon layer 81 formed on the surface of an electroconductive drum 82 made of Al or the like. Since the ratio by which such a conventional photoreceptor changes its electrical resistance by exposure to light is relatively small, a large amount of light energy is required if a sharp contrast is desired between light and dark areas in the image. The time-rate of change in resistance is typically as shown in FIG. 3. Thus, the exposure to light must be continued at least for a time duration indicated by the double-headed arrow in FIG. 3 in order to obtain a reasonably contrasty image.

SUMMARY OF THE INVENTION

It is therefore an object of the present invention to provide an image formation apparatus with which a toner image is formed not by applying toner onto the photoreceptor but onto a transfer medium such that the conventional image transfer process from the photoreceptor surface to a copy paper sheet and the cleaning process for removing toner from the photoreceptor surface can be dispensed with and that toner can be used in a more efficient manner.

It is another object of the present invention to provide an image formation apparatus using a method whereby toner is directly applied onto the photoreceptor surface without using a corona charger such that generation of ozone and nitrogen oxides can be prevented and there ill-effects on the produced image eliminated.

It is still another object of the present invention to provide an image formation apparatus using a method whereby an electrostatic latent image is transferred onto a dielectric sheet and toner is applied onto this dielectric sheet such that stress on the photoreceptor comprising amorphous silicon is reduced and that a clear image can be obtained.

It is still another object of the present invention to provide an improved photoreceptor capable of forming a contrasty resistance image thereon with a smaller amount of light energy.

According to one embodiment of the present invention, after what is referred to for convenience as a resistance image is formed on a photosensitive layer of a copier photoreceptor by exposure to reflected light from an original to be copied, an image transfer medium such as a copy paper sheet is attached onto this photosensitive layer such that an electrostatic image corresponding to this resistance image is formed on the medium by application of static electricity from its opposite surface. Toner is thereafter applied directly on this electrostatic image to form a visible toner image on the medium. In other words, toner does not come into contact with the photoreceptor at all and hence the photoreceptor is not subjected to any stress due to toner and there is no need, for example, of a cleaning device for removing residual toner from the photoreceptor surface. If the photoreceptor is grounded and if an electrode contacting the transfer medium and kept at an appropriate bias voltage is used instead of a corona charger for applying static electricity to form the electrostatic image on the medium, generation of ozone and nitrogen oxides and hence their known ill effects can be further prevented. As a variation to the embodiment described above, the resistance image formed on the photoreceptor may be converted into an electrostatic image by application of static electricity, say, by means of a corona charger before a transfer member is brought into contact with the photoreceptor surface. The electrostatic image on the photoreceptor in this case is transferred onto the medium by means of another charging device.

According to another embodiment of the present invention, a resistance image formed on a photosensitive layer as described above is directly converted into a visible toner image on the photoreceptor surface. For this purpose, a developing roller in a developing device kept at a bias voltage with respect to the photoreceptor is disposed close to the photoreceptor surface and toner particles attached on its surface are attracted to the photoreceptor surface and attached to the parts of the photoreceptor surface where electrical resistance has been increased by exposure to light. Alternatively, a charger such as a charging brush or a charging roller may be used to convert the resistance image on the photoreceptor surface into an electrostatic image before it comes to the position of the developing roller.

According to still another embodiment of the invention, after a resistance image formed on the photoreceptor surface is converted into an electrostatic image as described above, it is transferred onto a dielectric sheet which is brought into contact with it and toner is attached onto the electrostatic image transferred onto this dielectric sheet instead to form a toner image thereon.

By all these image formation methods embodying the present invention, the resistance image remains unaffected by the transfer of toner image onto a transfer medium. Thus, the original to be copied need not be exposed to light for each copy to be produced and many copies of a single original can be produced more efficiently than previously possible.

The present invention also relates to a photoreceptor with an amorphous silicon layer of a multi-layer structure, each layer having the characteristic of increasing its electrical resistance at a different rate when exposed to light. A photoreceptor thus structured is capable of producing a contrasty image even with a small amount of light energy.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

Figure 1:
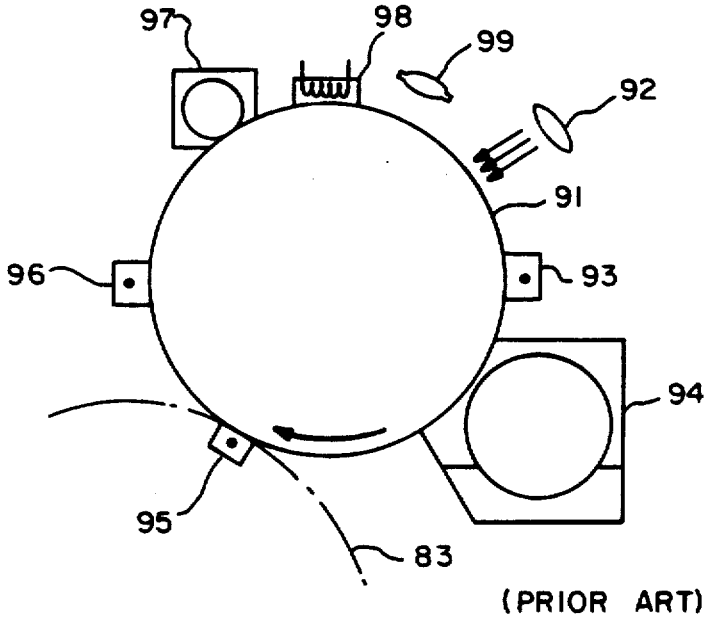
(PRIOR ART) FIG.—1
FIG. 1 is a schematic drawing of a prior art image formation apparatus.
Figure 2:
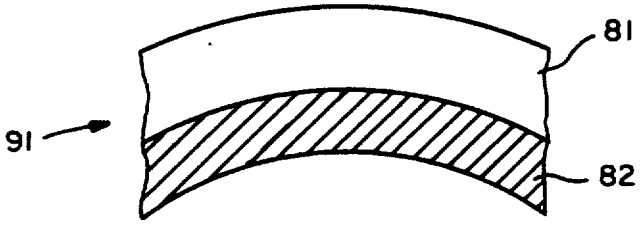
FIG.—2 (PRIOR ART)
FIG. 2 is a drawing showing the layer structure of a prior art photoreceptor.
Figure 3:
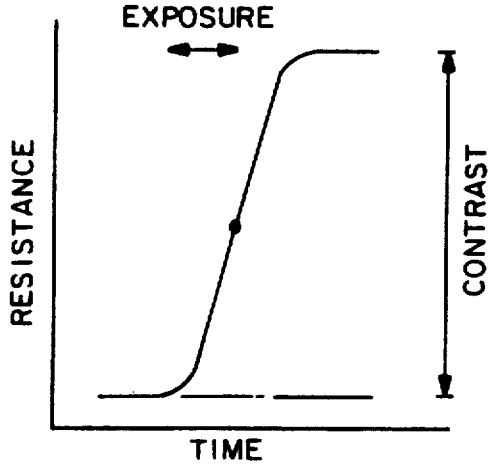
FIG.—3 (PRIOR ART)
FIG. 3 is a graph showing the time-rate of change in electrical resistance of a prior art photoreceptor.
Figure 4:
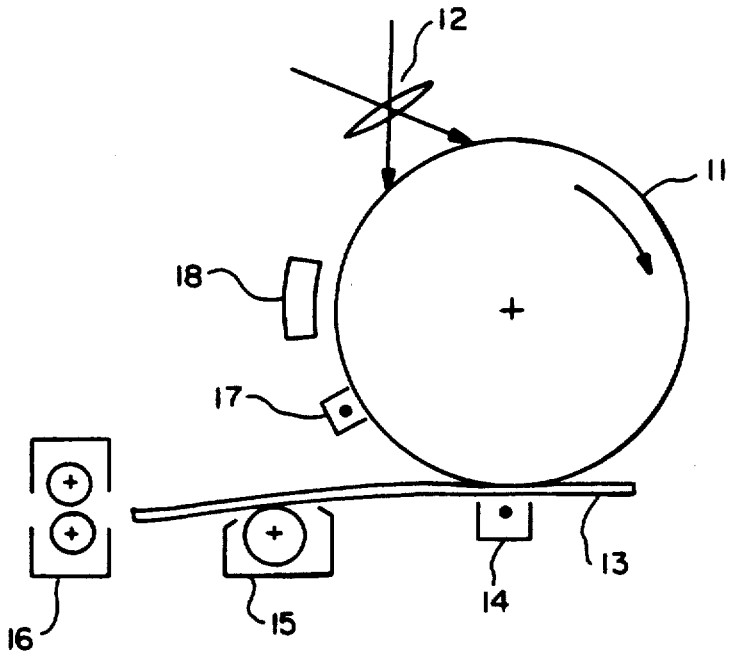
FIG. 4 is a schematic drawing of an image formation apparatus embodying the present invention.
Figure 5:
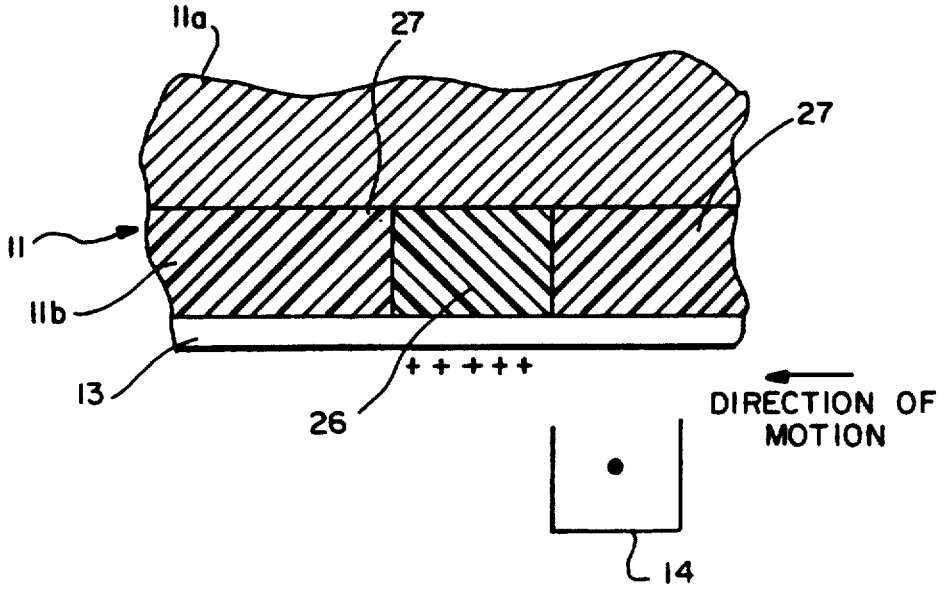
FIG. 5 is a drawing showing the process of forming electrostatic image by the apparatus of FIG. 4.

An image formation method according to a first embodiment of the present invention is explained in detail by way of FIGS. 4 and 5 which show an apparatus therefor. In FIGS. 4 and 5, numeral 11 indicates a photoreceptor comprised of an electroconductive supporting member 11*a* in the shape of a drum and a photosensitive layer 11*b* of an amorphous silicon material formed thereon. The amorphous silicon material has the characteristic of changing its electrical resistance when exposed to light. The photoreceptor 11 is rotated in the direction indicated by an arrow shown thereon and its photosensitive layer 11*b* is exposed to light from an optical system 12 such that a resistance image corresponding to a pictorial image on an original document (not shown) is formed on the photosensitive layer 11*b*. The optical system 12 may be of a type commonly used in conventional copiers but the reflected light from the original emitted therefrom must be energetic enough to cause a sufficiently large difference in electrical resistance in the photosensitive layer 11*b* between exposed and unexposed areas. A white light beam of about 10–100 mVsec/cm$^2$ is generally favorable although the choice naturally depends on the characteristics of the photosensitive layer 11*b*. After an exposure to such a light beam, the electrical resistance of exposed areas of the photosensitive layer 11*b* becomes greater than that of unexposed areas by a factor of about $10^2$–$10^3$.

Next, a transfer medium 13 such as a sheet of copy paper is transported in synchronism with the rotation of the photoreceptor 11 with one surface of the medium 13 firmly in contact with the photoreceptor surface as shown in FIG. 4 and the other surface of the medium 13 becomes electrically charged by corona discharge of a corona charger 14 disposed near the photoreceptor surface. In this situation, the electrostatic charges become distributed according to the resistance image formed on the photosensitive layer 11*b*, that is, an electrostatic latent image corresponding to this resistance image is formed on the medium 13. With reference to FIG. 5 which shows this phenomenon more in detail, numerals 26 and 27 indicate an exposed area and an unexposed area of the photosensitive layer 11*b*, respectively. The electrical resistance of the exposed area 26 is greater than that of the unexposed area 27 by a factor of about $10^2$–$10^3$ as disclosed above. The contrast between these areas 26 and 27 according to an experiment wherein a corona charge of $+0.3\mu c/cm^2$ was given to the medium 13 was +480 V at the exposed area 26 against +105 V at the unexposed area 27.

After the electrostatic latent image is thus formed on the transfer medium 13, a developing device 15 serves to apply toner onto the medium 13 to form a visible toner image thereon. The developing device 15 contains a two-component developing agent and as it is stirred, the toner becomes positively charged. Since the electrostatic latent image on the medium 13 is a negative image with respect to the pictorial image on the original document being copied, the positively charged toner serves to produce a positive image on the medium 13. If a charger for negative corona discharge is substituted, therefore, a negative copy can be obtained by using the same (positively charged) toner. In other words, both positive and negative images can be selectably obtained easily merely by changing the polarity of the corona charger 14. Although it is not shown in FIG. 4, it is preferable to apply an appropriate bias voltage in the developing process as commonly done in conventional electrophotography.

The transfer medium 13 with a toner image formed thereon is transported to a fixing device 16 to have the image fixed on the medium 13. Numeral 17 indicates a charge removing device. Since the photoreceptor 11 also becomes electrostatically charged when the corona charger 14 applies electrostatic charges to the transfer medium 13, the charges remaining on the photoreceptor 11 are neutralized by this charge removing device 17. Experiments have shown that copies with high image density and no fogginess in white areas could be obtained with a copier thus structured.

When it is desired to make another copy of the same original, this can be done in a simplified manner because the resistance image formed on the photosensitive layer 11*b* is not destroyed by the transfer process described above. In other words, there is no need to activate the optical system 12 to expose the photoreceptor 11 again to the reflected light from the original. Thus, after the residual positive charges on the photoreceptor 11 are cancelled by an AC corona discharge of the charge removing device 17, the image-forming process is omitted and the charging process is carried out immediately. Although the photoreceptor 11 cannot be rotated too fast when it is exposed to light to have an image formed thereon because a large amount of light energy must be received by the photoreceptor surface as explained above, a faster rate of rotation becomes allowable in this mode of operation since there is no need to repeatedly expose the photoreceptor surface to light. As a result, the present invention makes high-speed copying possible without the need for toner transfer and toner cleaning processes which were required in conventional electrophotographic methods.

When it is desired to copy a different original image, the existing resistance image is erased first by an infrared heater 18 serving as thermal annealing means and then the photoreceptor 11 is exposed to the next original. For the thermal annealing process, not only is power supplied to the infrared heater 18 such that the surface temperature of the photoreceptor 11 becomes about 150°-200° C. but also the rotary speed of the photoreceptor 11 is reduced to about 1-2 rpm such that the erasing can take place for a sufficiently long time and that the remaining resistance image will be completely erased. After such an erasing process, the difference in electrical resistance nearly completely disappears between the formerly exposed and unexposed areas of the photosensitive layer **11*b***.

An aging test conducted with a copier thus structured showed that there was hardly any change in the characteristics of the photoreceptor after about 1,000,000 copy sheets had been processed. It was because the photoreceptor was not subjected to any stress from toner and the quality of copied image remained as good as at the beginning of the test. For the purpose of this aging test, the photoreceptor was rotated at the rate of 50 rpm when many copies were produced from a single original and repeated exposure to light was not necessary and at a slower rate of 1-2 rpm when a new exposure to light was necessary.

Figure 6:
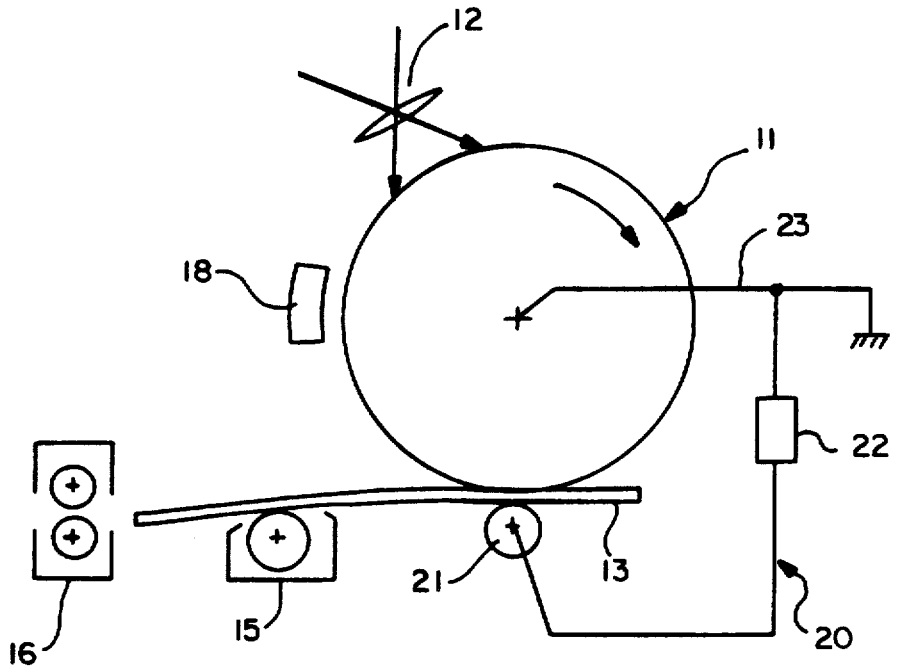
FIG. 6 is a schematic drawing of another image formation apparatus embodying the present invention.
Figure 7:
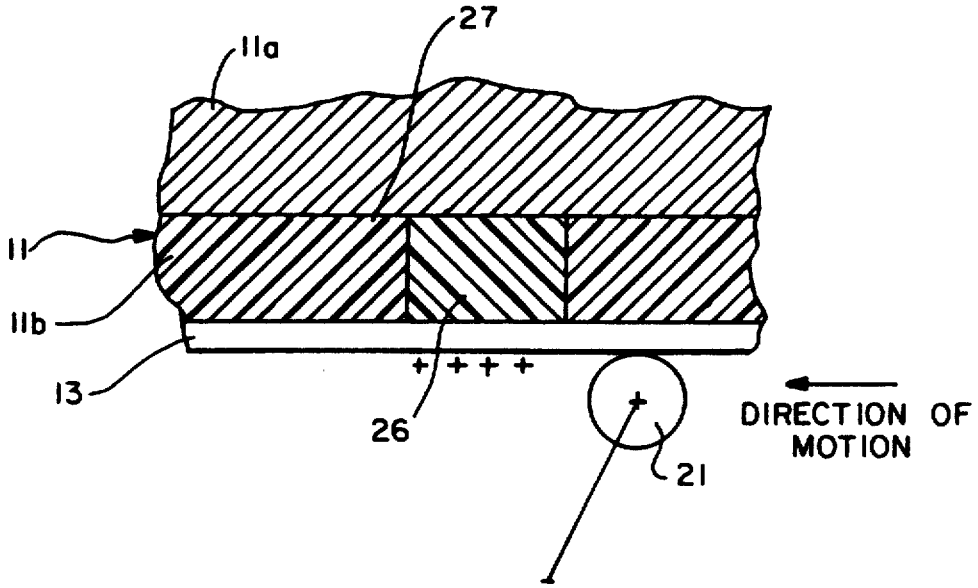
FIG. 7 is a drawing showing the process of forming electrostatic image of FIG. 6.

Another image formation method according to a second embodiment of the present invention is explained next by way of FIGS. 6 and 7 which show an apparatus therefor. In FIGS. 6 and 7, components which are substantially identical or at least similar to those shown in FIGS. 4 and 5 and explained above in connection therewith are indicated by the same numerals and are not explained again. This method to be explained below by way of FIGS. 6 and 7 is different from the one explained above in the manner in which the electrostatic image is formed on the transfer medium 13. According to this second embodiment, use is made of a charging device 20 comprised of a roller electrode 21 which contacts the surface of the medium 13 on the side opposite from the photoreceptor 11, a high-voltage source 22 with one terminal connected to the roller electrode 21 and the other terminal connected to the supporting member **11*a* of the photoreceptor 11 and a grounding circuit 23 for grounding the supporting member 11*a*. In other words, the electrostatic latent image is formed according to this embodiment by this roller electrode 21 connected to a high-voltage source instead of a corona discharge as better shown in FIG. 7 which is to be compared with FIG. 5. In an experiment wherein a voltage of +2.5 kV from the source 22 was applied to the medium 13, an image contrast of about 320 V was obtained, the voltage being about 60 V at unexposed areas 27 and about 380 V at exposed areas 26 where the electrical resistance was greater by a factor of about $10^2$-$10^3$ as in the previous embodiment. With the apparatus shown in FIG. 6, too, both positive and negative images can be produced selectably by merely changing the polarity of the charging device. One advantage of this embodiment is that the charge removing device 17 of FIG. 4 can be dispensed with because the photoreceptor 11 is grounded according to this embodiment and does not become charged when an electrostatic image is formed on the medium 13**. Performance and aging tests with an apparatus according to this embodiment of the present invention also showed equally favorable results.

Figure 8:
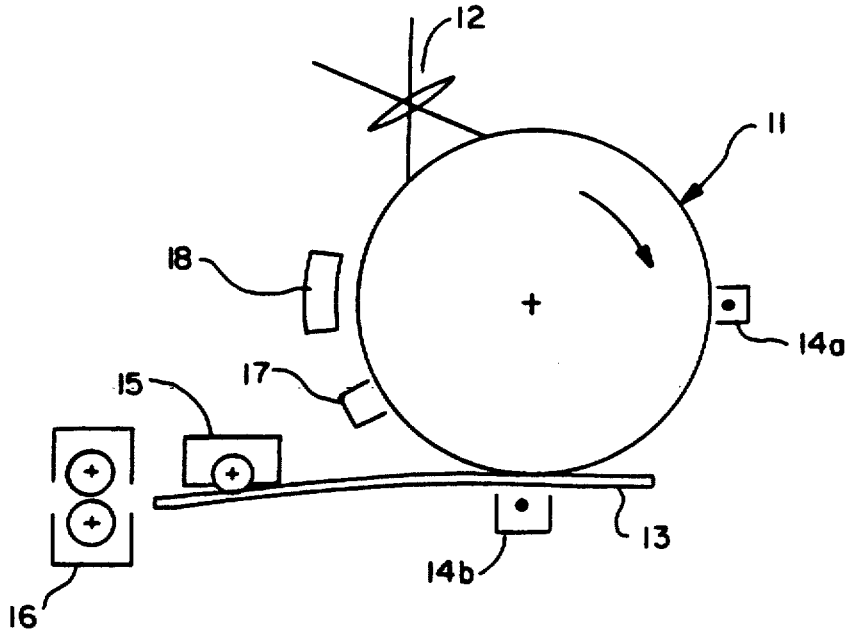
FIG. 8 is a schematic drawing of still another image formation apparatus embodying the present invention.
Figure 9:
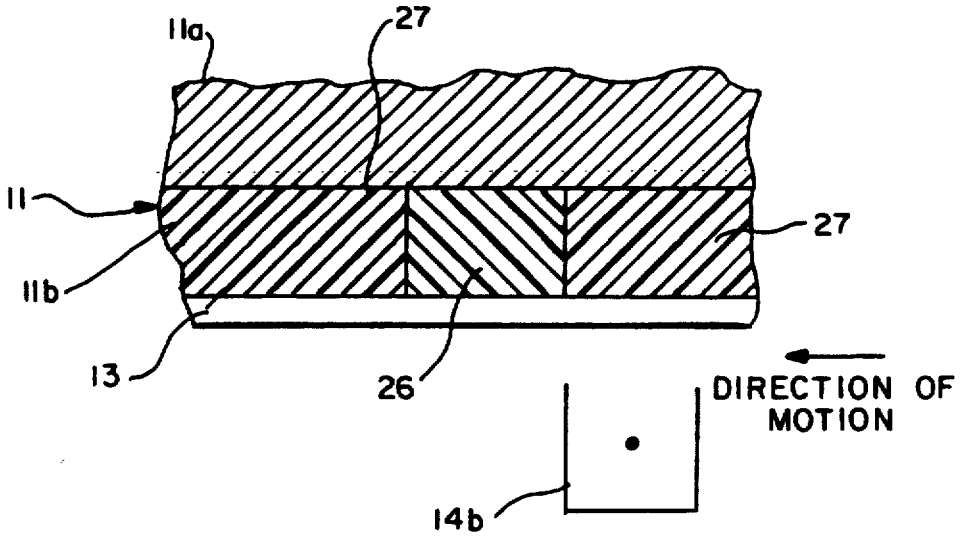
FIG. 9 is a drawing showing the process of transferring electrostatic image by the apparatus of FIG. 8.

Still another image formation method according to a third embodiment of the present invention is explained next by way of FIGS. 8 and 9 which show an apparatus therefor. In FIGS. 8 and 9, as in FIGS. 6 and 7, components which are substantially identical or at least similar to those shown in FIGS. 4 and 5 and explained above in connection therewith are indicated by the same numerals and are not explained again. The method to be explained below by way of FIGS. 8 and 9 is similar to the one explained above by way of FIGS. 4 and 5 but is different therefrom in that two corona chargers **14*a* and 14*b* are used. A first charger 14*a* is disposed between the position where the photoreceptor surface is exposed to light and the position where it comes into contact with the incoming transfer medium 13 and serves to form an electrostatic latent image by a corona discharge. A second charger 14*b* is disposed so as to attach electrostatic charges on the transfer medium 13 from the side opposite from the photoreceptor 11 and serves to transfer the electrostatic image from the photosensitive layer 11*b* of the photoreceptor 11 onto the medium 13. In an experiment wherein a corona charge of $+0.3\mu c/cm^2$ was given to the photosensitive layer 11*b* by the first charger 14*a* and another corona charge of $-0.2\ \mu c/cm^2$ was given to the medium 13 by the second charger 14*b*, a voltage contrast of about 320 V was obtained, the voltage being about 30 V at unexposed areas 27 and about 350 V at exposed areas 26 where the electrical resistance was greater by a factor of about $10^2$-$10^3$ as in the previous examples. With the apparatus shown in FIG. 8, too, both positive and negative images can be produced selectably by changing the polarity of the chargers 14*a* and 14*b*. Performance and aging tests conducted also with an apparatus thus structured as shown in FIG. 8** showed equally favorable results.

The present invention has been explained above by way of three embodiments but they are not intended to limit the scope of the invention. Many modifications and variations are possible within the scope of the present invention. For example, the fixing device 16 need not be of a type using heat rollers as symbolically shown in FIGS. 4, 6 and 8. A fixing device of the pressure or oven type may be substituted. As another example of the annealing means, a laser beam may be used instead of the infrared heater 18.

The methods and apparatus of the present invention described above have the following advantages. Firstly, since toner is not attached to the photoreceptor, there is no problem of residual toner on the photoreceptor surface and the cleaning process can be dispensed with. Secondly, since toner is directly applied to the transfer medium, the transfer process whereby the toner image on the photoreceptor is transferred onto the transfer medium can be dispensed with and hence toner can be used 100% effectively. Thirdly, since toner is not attached onto the photoreceptor, the photoreceptor is not subjected to any stress from a toner film. Fourthly, high-speed copying becomes possible when many copies of a single original are produced because the photoreceptor surface need not be exposed to a reflected beam of light from the original for each copy. Fifthly, both positive and negative images can be selectably obtained, independent of the charging characteristics of the photoreceptor. In the case of the second embodiment, there are additional advantages of not requiring a charge removing device and of not generating ozone and nitrogen oxides because no corona discharge is involved in the process.

Figure 10:
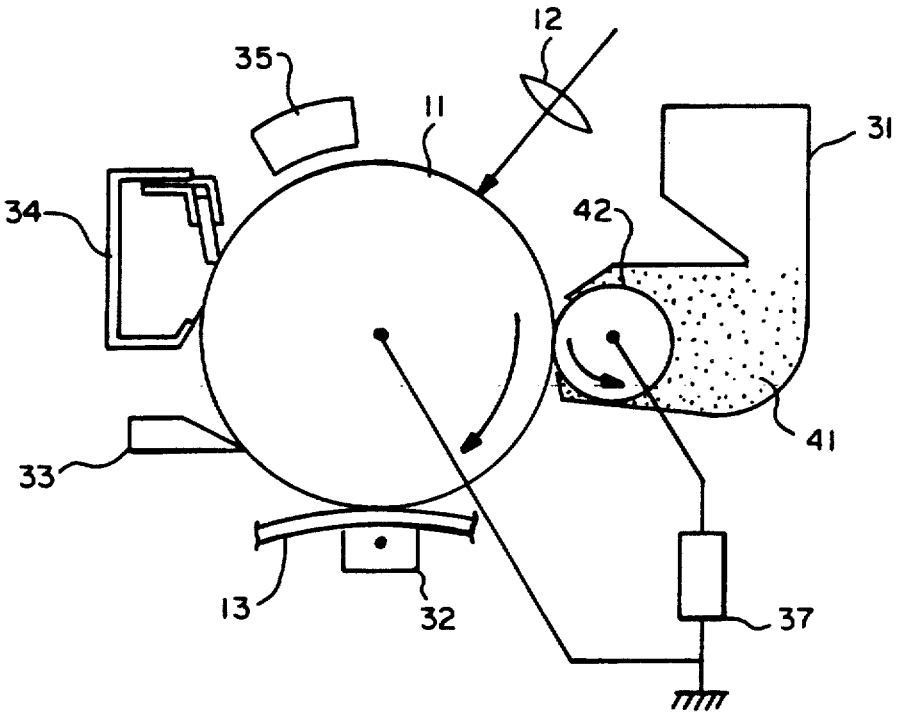
FIG. 10 is a schematic drawing of still another image formation apparatus embodying the present invention.
Figure 11:
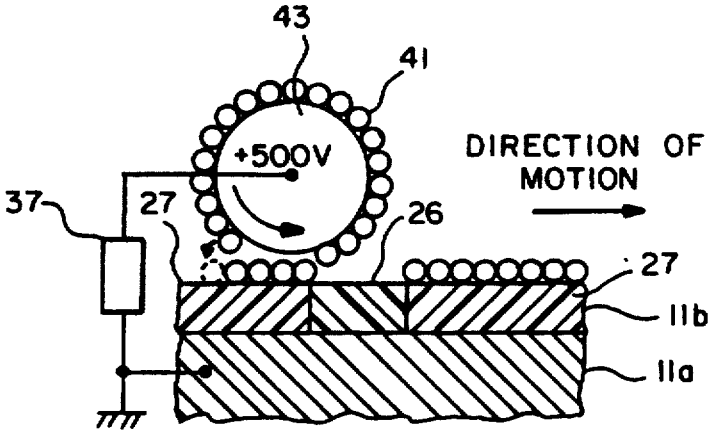
FIG. 11 is a drawing showing the process of forming toner image by the apparatus of FIG. 10.

Several additional electrophotographic image formation methods using a resistance image are explained as embodiments of the present invention. A copier which makes use of one of these methods is schematically shown in FIG. 10 wherein numeral 11 again indicates a photoreceptor comprised, as shown in FIG. 11, of a supporting member 11*a* such as an aluminum drum and a photoconductive layer 11*b* of which the electrical resistance changes significantly when exposed to light. Amorphous silicon doped with boron, phosphorus or the like such that its electrical resistance increases when exposed to light is used. As shown both in FIGS. 10 and 11, the supporting aluminum member 11*a* is grounded. According to this embodiment, the photoreceptor 11 is surrounded by a developing device 31, an image transferring device 32, a doctor blade 33, a cleaning device 34 and a heater 35 in this order as shown in FIG. 10. The developing device 31 is filled with electroconductive toner 41 with a coloring agent such as carbon black and a magnetic material such as magnetite powder mixed in a resin. Numeral 42 indicates a developing roller disposed opposite to the photoreceptor surface. The developing roller 42 is composed of a cylindrical sleeve 43 made of an electroconductive material and a magnet (not shown) contained therein. The magnet serves to hold the toner 41 on the circumference of the sleeve 43 as shown in FIG. 11. The sleeve 43 is adapted to rotate as shown by an arrow thereon in FIG. 10 and a bias voltage of about +500 V is applied thereon by a bias voltage source 37.

The image transferring device 32 may be a corona charger as shown at 14 in FIG. 4 for transferring the toner attached on the photoreceptor surface onto a transfer medium 13 such as a sheet of copy paper. If use is made of a bias roller instead, generation of ozone and nitrogen oxides can be prevented. The doctor blade 33 is for separating the transfer medium 13 from the photoreceptor surface and the cleaning device 34 is for removing the toner and dust particles which remain attached on the photoreceptor surface. The heater 35 is adapted to heat the photoreceptor surface to 150°-200° C.

When an optical system 12 causes the photoreceptor 11 to be exposed to a reflected beam preferably of white light of about 10-100 mWsec/cm$^2$ from an original to be copied, the electrical resistance of the amorphous silicon photoconductive layer 11*b* corresponding to a white area on the document becomes greater than that at areas corresponding to a black image on the original. In FIG. 11, numeral 26 again indicates a part of the amorphous silicon layer 11*b* where the electrical resistance has increased by exposure to such a white beam of light and numeral 27 indicates a part which has not been exposed to the light from the optical system 12 or a part corresponding to a black area on the original.

As the photoreceptor 11 rotates and the part of its surface where a resistance image as represented by exposed and unexposed areas 26 and 27 in FIG. 11 is formed comes to the position opposite to the developing roller 42, the electroconductive toner 41 staying on the surface of the sleeve 43 by the force of the magnet is accelerated by the bias voltage of +500 V on the developing roller 42 and becomes attached to the areas 27 of the amorphous silicon layer 11*b* where electrical resistance is low. Although a positive bias voltage is illustrated in FIG. 11, the bias voltage may be a negative voltage. According to tests, a bias voltage of about +500 V or −500 V is preferable. If its absolute value is less than 300 V, attachment of toner 41 is not sufficient and the resultant image is not clear enough. In general, the optimum bias voltage depends on the dimensions of the photoreceptor, its material, its characteristics, the characteristics of the toner being used, etc.

In FIG. 10, numeral 13 again indicates an image transfer medium which is transported in synchronism with the rotation of the photoreceptor 11. As the photoreceptor 11 rotates still further and brings the toner image formed thereon to the position of the transfer device 32, the toner image on the photoreceptor surface is transferred onto the medium 13 which is then separated from the photoreceptor surface by means of the doctor blade 33, transported to a fixing device (not shown) to have the toner image fixed and then discharged. The unused portion of the toner remaining on the photoreceptor surface is separated and removed therefrom by the cleaning device 34. Since the resistance image once formed by the exposure of the photoreceptor surface to light remains after the transfer processes described above, it can be used again if two or more copies of the same original are desired. After a desired number of copies has been produced from a single original, the heater 35 is activated to heat the photoreceptor surface to about 150°-200° C. and the rotary motion of the photoreceptor is slowed down as taught above in connection with the other examples such that the resistance image can be completely erased. Tests have shown that the difference in resistance between exposed and unexposed areas disappears nearly completely if the speed of the photoreceptor rotation is reduced to about 1-2 rpm.

As a variation to the method described above, use may be made of toner of insulative type. Insulative toner can be charged either positively or negatively by a charger (not shown) disposed within the developing device 31 such that toner image can be formed on the photoreceptor by applying a bias voltage between the photoreceptor and the developing roller. Both positive and negative images can be formed selectably by controlling the polarity of the toner charger and the bias voltage. If the photosensitive layer of the photoreceptor is formed with a material of which the electrical resistance decreases when exposed to light, electroconductive toner may be used to obtain both positive and negative images selectably. In summary, the copier described above by way of FIGS. 10 and 11 also achieves the aforementioned objects of the present invention.

Another copier operating on another method embodying the present invention is described next by way of FIGS. 12 and 13 wherein the same numerals are used to indicate identical or similar components already described. In FIGS. 12 and 13, numeral 11 again indicates a photoreceptor with a grounded aluminum drum 11*a* and a photosensitive layer 11*b* formed on its surface but the photosensitive layer 11*b* in this example comprises amorphous silicon of a type which normally has high electrical resistance but reduces its resistance when exposed to light. This copier is different from the one shown in FIGS. 10 and 11 in that a charging device 50 is provided between the optical unit 12 by which reflected light from an original document to be copied is made incident onto the photoreceptor surface and the developing device 31. The charging device 50, unlike a corona charger in a conventional copier, comprises a conductive brush 51 made of nylon, carbon or the like and a bias voltage source 52 for applying a bias voltage of about +800 V thereon. The developing device 31 contains a two-component developing agent 46 essentially consisting of toner which becomes negatively charged by friction and a carrier such as iron powder. The two components of the developing agent 46 are stirred together by a stirring roller 47 which rotates inside the developing device 31 and the toner becomes charged negatively while the carrier becomes positively charged. A bias voltage of about +150 V is applied to the developing roller 42 such that the toner becomes attached to its peripheral surface. The image transfer device 32, the doctor blade 33, the cleaning device 34 and the heater 35 shown surrounding the photoreceptor 11 are adapted to function as explained in connection with FIG. 10.

The optical system 12 serves to form a resistance image on the photosensitive layer 11*b* of the photoreceptor 11 by providing a white light beam of about 10–100 mWsec/cm$^2$ as explained above. In this example, the electrical resistance of the photosensitive layer 11*b* becomes low at the exposed parts 26 corresponding to a white area on the original document and remains high at unexposed parts 27 corresponding to a black area on the original. The ratio of electrical resistance between the two parts is about $10^2$–$10^3$. With a bias voltage of about +800 V applied to the charging brush 51, an electrostatic image is easily formed according to the resistance image formed by the exposed and unexposed areas 26 and 27 on the photosensitive layer 11*b* as shown in FIG. 13 because the electrical resistance of the unexposed areas 27 is sufficiently high. Experiments showed that the voltage of the resultant electrostatic image was about +430 V.

Figure 12:
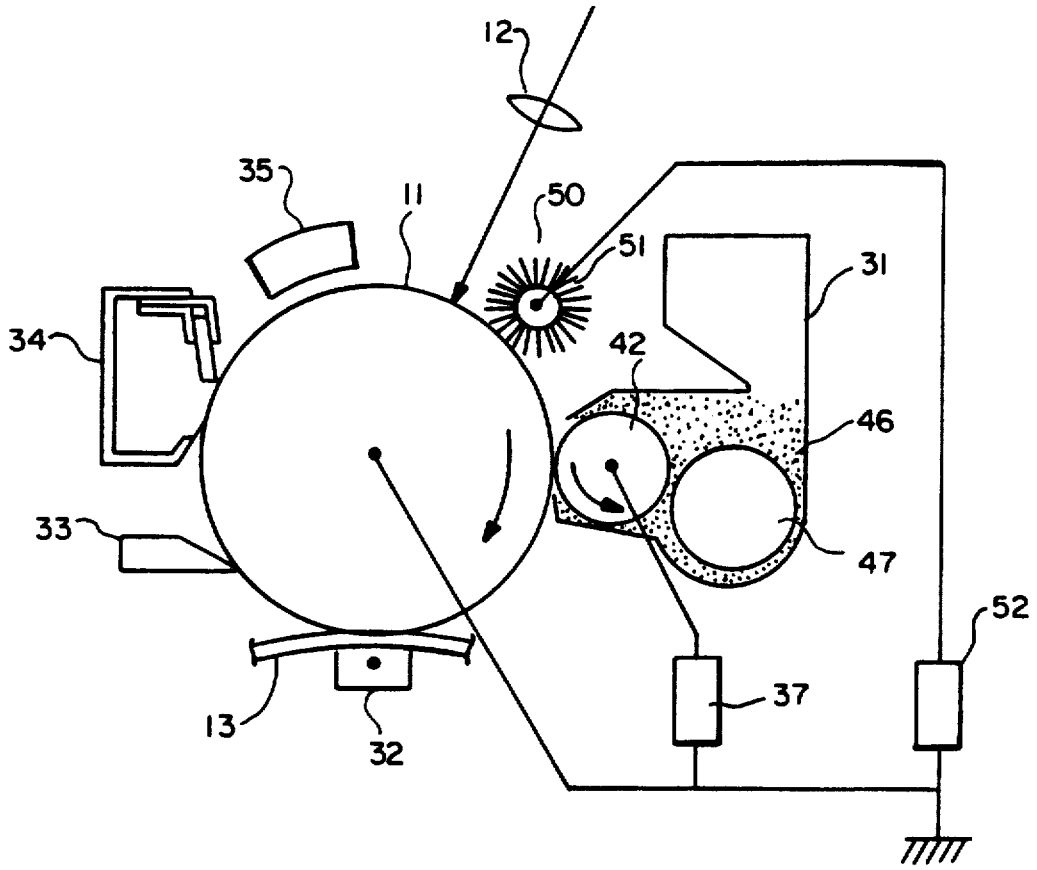
FIG. 12 is a schematic drawing of still another image formation apparatus embodying the present invention.
Figure 13:
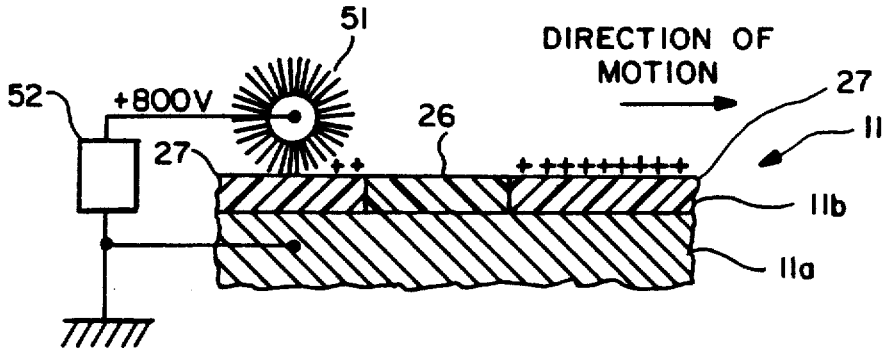
FIG. 13 is a drawing showing the process of forming electrostatic image by the apparatus of FIG. 12.

As the photoreceptor rotates in the direction of the arrow shown thereon in FIG. 12, the electrostatic latent image thus formed by the charging device 50 moves to the position of the developing device 31 where toner becomes attached onto the electrostatic image by the developing roller 42, thereby forming a visible toner image. In other words, the toner already attached to the developing roller 42 at +150 V becomes attracted by the electrostatic image at +430 V onto the photoreceptor surface. The toner image thus formed on the photoreceptor surface is thereafter transferred onto the transfer medium 13 such as a copy paper sheet in a known manner as described above. It now goes without saying that the copier described above by way of FIGS. 12 and 13 also can achieve the objects of the present invention. Instead of a conductive brush, a charging roller may be used as the charging device 50 although an apparatus using such a charging roller is not separately illustrated. The brush 51 may alternatively comprise a polyester or polyethylene material, depending on the polarity of the charging device 51. The bias voltages may be appropriately varied from the values disclosed above.

Figure 14:
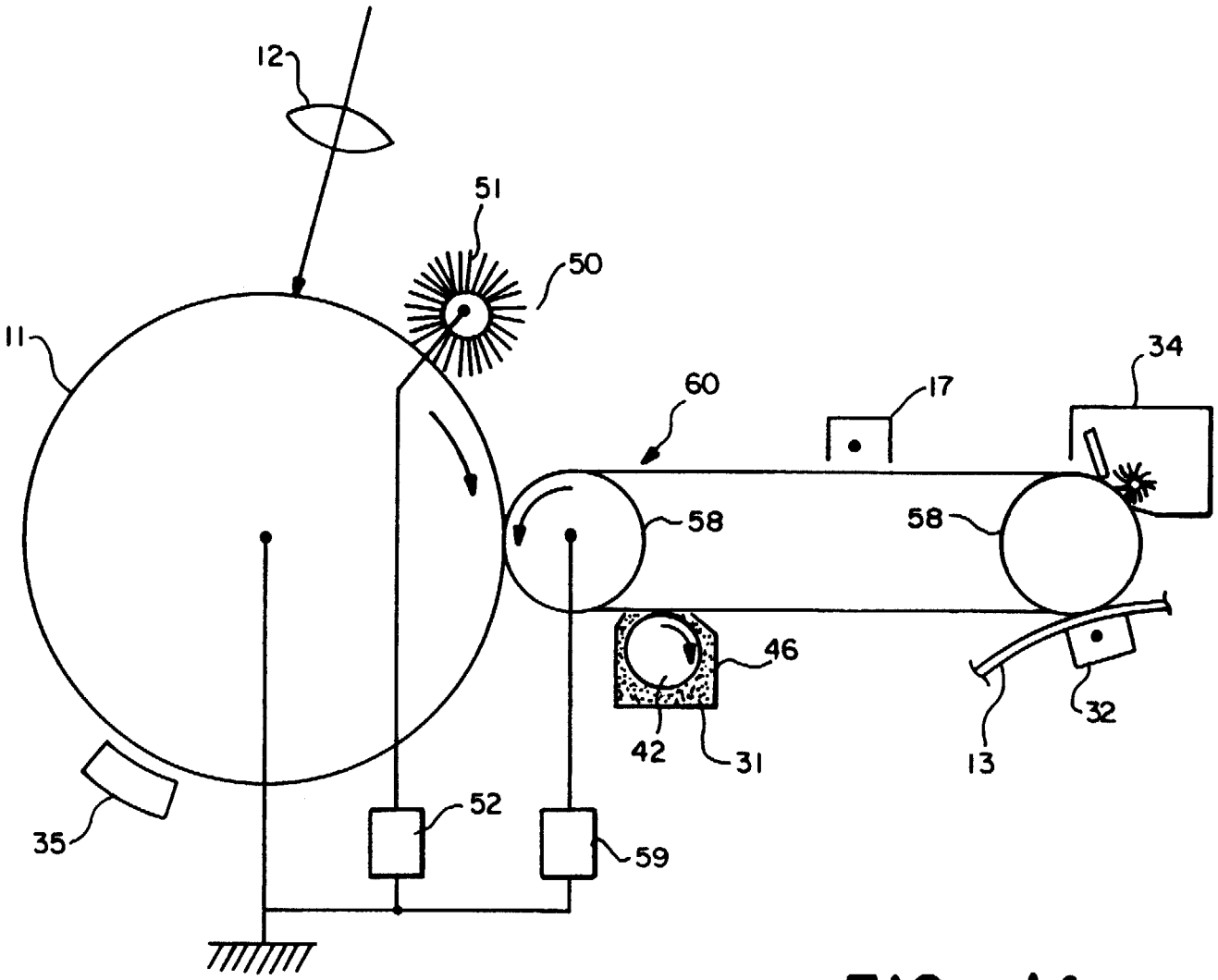
FIG. 14 is a schematic drawing of still another image formation apparatus embodying the present invention.
Figure 15:
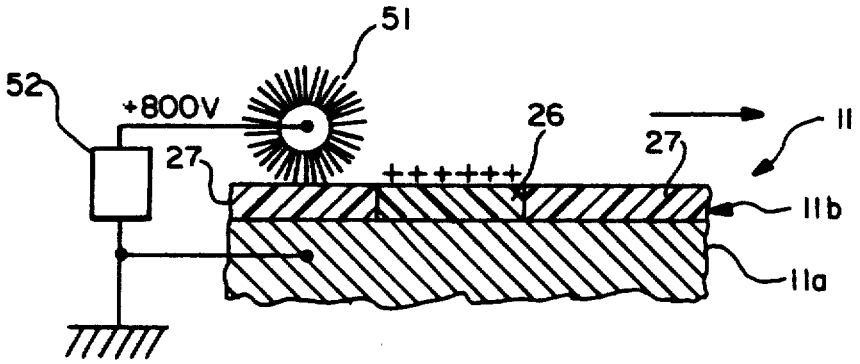
FIG. 15 is a drawing the process of forming electrostatic image by the apparatus of FIG. 14.

Still another copier operating on still another method embodying the present invention is described next by way of FIGS. 14, 15 and 16 wherein the same numerals indicate identical or similar components already described. The photoreceptor 11 comprises a grounded aluminum drum 11*a* and a photosensitive layer 11*b* formed on its surface. Unlike the photoreceptor of FIGS. 12 and 13, however, the photosensitive layer 11*b* of this photoreceptor shown in FIG. 14 comprises amorphous silicon of a different type which has normally low electrical resistance and has it increased when exposed to light. The copier shown in FIG. 14 is different from the one shown in FIG. 12 in that its developing device 31 is disposed away from the photoreceptor surface and that an endless dielectric sheet 60 in the form of a conveyor belt is stretched between a pair of rollers 58. A bias voltage of about −1200 V is applied to this dielectric sheet 60 by means of a transfer bias voltage source 59. Disposed near the developing device 31 are a transfer device 32, a cleaning device 34 and a charge removing device 17.

The developing device 31 contains a two-component developing agent with a carrier and toner of a type which becomes positively charged by friction. The developing agent 46 is stirred by a stirring roller (not shown) as described above by way of FIG. 12 and the positively charged toner is attracted to the developing roller 42 disposed opposite to the dielectric sheet 60.

The image transfer device 32 serves to transfer the toner from the surface of the dielectric sheet 60 onto a transfer medium 13 by a corona discharge. The cleaning device 34 and the charge removing device 17 have the same functions as described above. The cleaning device 34 in this copier is normally separated from the dielectric sheet 60 and is brought into contact therewith when cleaning of the sheet 60 is required.

When a white light beam of about 10–100 mWsec/cm$^2$ reflected from an original to be copied is made incident on the photoreceptor surface by the optical system 12, a resistance image is formed on the photosensitive layer 11*b* as explained above except the electrical resistance of exposed parts 26 becomes higher than that of unexposed parts 27 in this example by a factor of about $10^2$–$10^3$. Thus, when the resistance image thus formed on the photoreceptor surface moves to the position of the brush 51 which is positively biased as explained above, only the areas 26 at which the electrical resistance is higher by exposure to light become electrostatically charged because of the large difference in electrical resistance between the exposed and unexposed areas 26 and 27. Experiments have shown that the voltage of the electrostatic latent image thus formed on the photoreceptor surface was about +430 V.

Figure 16:
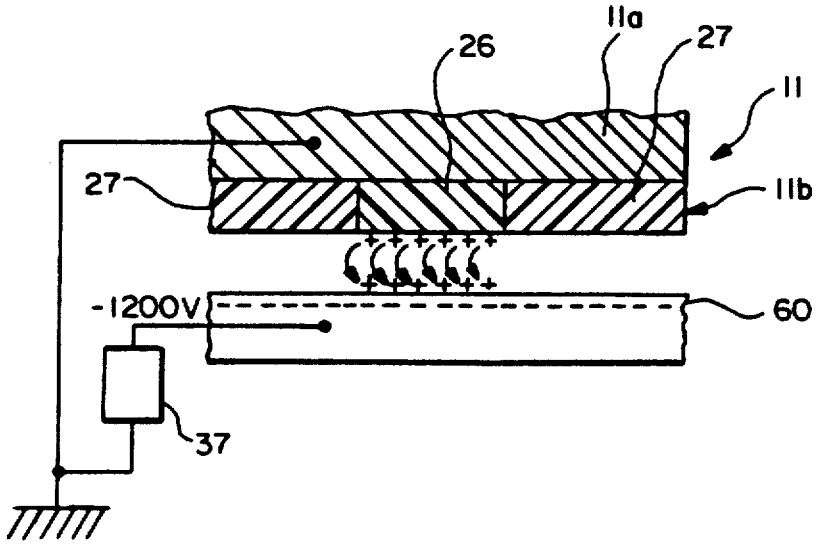
FIG. 16 is a drawing showing the process of transferring electrostatic image by the apparatus of FIG. 14.

As the photoreceptor 11 rotates still further in the direction of the arrow shown thereon, the electrostatic latent image thus formed by the brush 51 comes to the position opposite to the dielectric sheet 60 and is transferred thereonto across the small gap between the photoreceptor surface and the dielectric sheet 60 as shown in FIG. 16 due to the bias voltage of −1200 V applied to the sheet 60 by the bias voltage source 59. Since the electrostatic latent image on the photoreceptor 11 is a clear image produced from a resistance image, it remains clear even after it is transferred onto the dielectric sheet 60. The electrostatic image formed on the dielectric sheet 60 is such that parts corresponding to a white area on the original are electrostatically charged.

As the rollers 58 rotate in the direction indicated by an arrow and the electrostatic latent image formed on the dielectric sheet 60 is brought to the position of the developing device 31, positively charged toner is attached to the uncharged parts of the dielectric sheet 60 corresponding to black areas on the original because of the coulomb force, thereby forming a visible toner image on the dielectric sheet 60. This toner image is thereafter transferred onto the transfer medium 13 by means of the transfer device 32 in a well-known manner, fixed by a fixing device (not shown) and discharged.

The electrostatic image formed on the dielectric sheet 60 remains undisturbed by these developing and transferring processes. If it is desired to obtain two or more copies of the same original, therefore, its electrostatic image need not be reformed. One has only to attach toner by the developing device 31 to form another toner image from the remaining electrostatic image and to have it transferred onto another transfer medium. When the copier is operated in this mode, there is no need to clean the dielectric sheet 60 to remove residual toner from its surface after each transfer process by the transfer device 32. Thus, the cleaning device 34 is kept separated from the dielectric sheet 60 in this mode of operation and residual toner after each transfer process is used again in the next cycle of copying. The cleaning device 34 is brought into contact with the dielectric sheet 60 after a desired number of copies has been produced such that the accumulated toner is scraped off by using a cleaning blade or a fur brush so that no ghost will show when a new image is formed on the dielectric sheet 60. Thereafter, the charge removing device 17 and the heater 35 are activated to erase the electrostatic image left on the dielectric sheet 60 and the resistance image left on the photoreceptor 11.

In order to form a sufficiently contrasty resistance image on the photoreceptor 11, the time of its exposure to light from the optical system 12 must be sufficiently long. In order to accurately transfer an electrostatic image from the photoreceptor 11 onto the dielectric sheet 60, too, the transfer process must be carried out sufficiently slowly. For these reasons, the photoreceptor 11 should be rotated sufficiently slowly. Experiments have shown that a clear image is obtainable and the difference in electrical resistance between exposed and unexposed areas becomes hardly noticeable after the heating process if the photoreceptor 11 is rotated at the rate of about 1-2 rpm. When a toner image is formed from an electrostatic latent image on the dielectric sheet 60, however, there is no ill-effect if the speed of the sheet 60 is increased. Experiments have also shown that clear images of high quality are obtainable with the speed of the dielectric sheet 60 set at 50 rpm. Since the photoreceptor 11 is not needed any longer after the electrostatic image thereon has been transferred onto the dielectric sheet 60 while a toner image is being formed thereon, the heating process with the heater 35 can already be initiated to erase the resistance image thereon. This helps to reduce the overall processing time of the operation. Aging tests were also carried out with a copier of this type. After 100,000 copies were produced with a photoreceptor 11 made of amorphous silicon, the quality of produced image was as good as at the beginning of the test because the photoreceptor 11 is not subjected to any stress from toner. If amorphous silicon of a different type which has high electrical resistance and has it decreased when exposed to light is used instead, a negative image with black and white areas interchanged is obtained.

Figure 17:
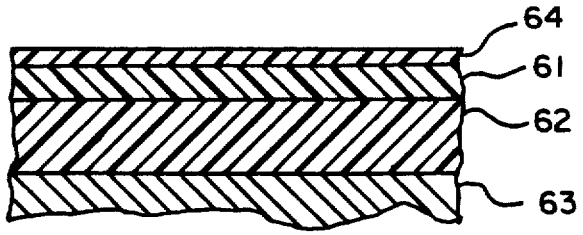
FIG. 17 is a drawing showing the layer structure of a photoreceptor embodying the present invention.

As stated above, the present invention, in another aspect thereof, is addressed to the problem of providing a photoreceptor with which a contrasty image can be obtained even with a relatively small amount of light energy and relates to an improved photoreceptor of the type comprising an electroconductive supporting member and an amorphous silicon layer which increases its electrical resistance when exposed to light and characterized in that this amorphous silicon layer is formed with a plurality of layers each changing its resistance at a different rate when exposed to light. FIG. 17 is a sectional view showing the layer structure of such a photoreceptor embodying the present invention and numeral 63 therein indicates an electroconductive supporting member, for example, of aluminum upon which are formed two amorphous silicon layers 61 and 62 as well as a surface protective layer 64. For effectively utilizing light energy, an antireflective layer (not shown) may also be provided. The protective layer 64 is for stability against environmental effects, etc. and may comprise any known material for the purpose. Since it is to be formed on an amorphous silicon layer formed by a plasma chemical vapor deposition (CVD) method, it is preferable that the protective layer 64 also be formed by a plasma CVD method. It may comprise, for example, a-$Si_3N_4$:H, a-SiC:H or a-$SiO_2$:H. A thickness on the order of 0.01-3$\mu$m is preferred.

The two amorphous silicon layers 61 and 62 are hereinafter respectively referred to for convenience as the first amorphous silicon layer 61 which changes its electrical resistance more when exposed to light and the second amorphous silicon layer 62 which changes its electrical resistance less when exposed to light. The first amorphous silicon layer 61 may comprise a-Si:H:B:N:O with thickness preferably in the range of 0.3-3$\mu$m and more preferably in the range of about 0.1-1$\mu$m. The second amorphous silicon 62 may comprise a-Si:H:B with thickness preferably in the range of about 1-5$\mu$m. It is to be kept in mind, however, that the description given above by way of FIG. 17 is intended to be illustrative, and not limitative. Three or more amorphous silicon layers of mutually different photoconductive characteristics may be used.

Figure 18:
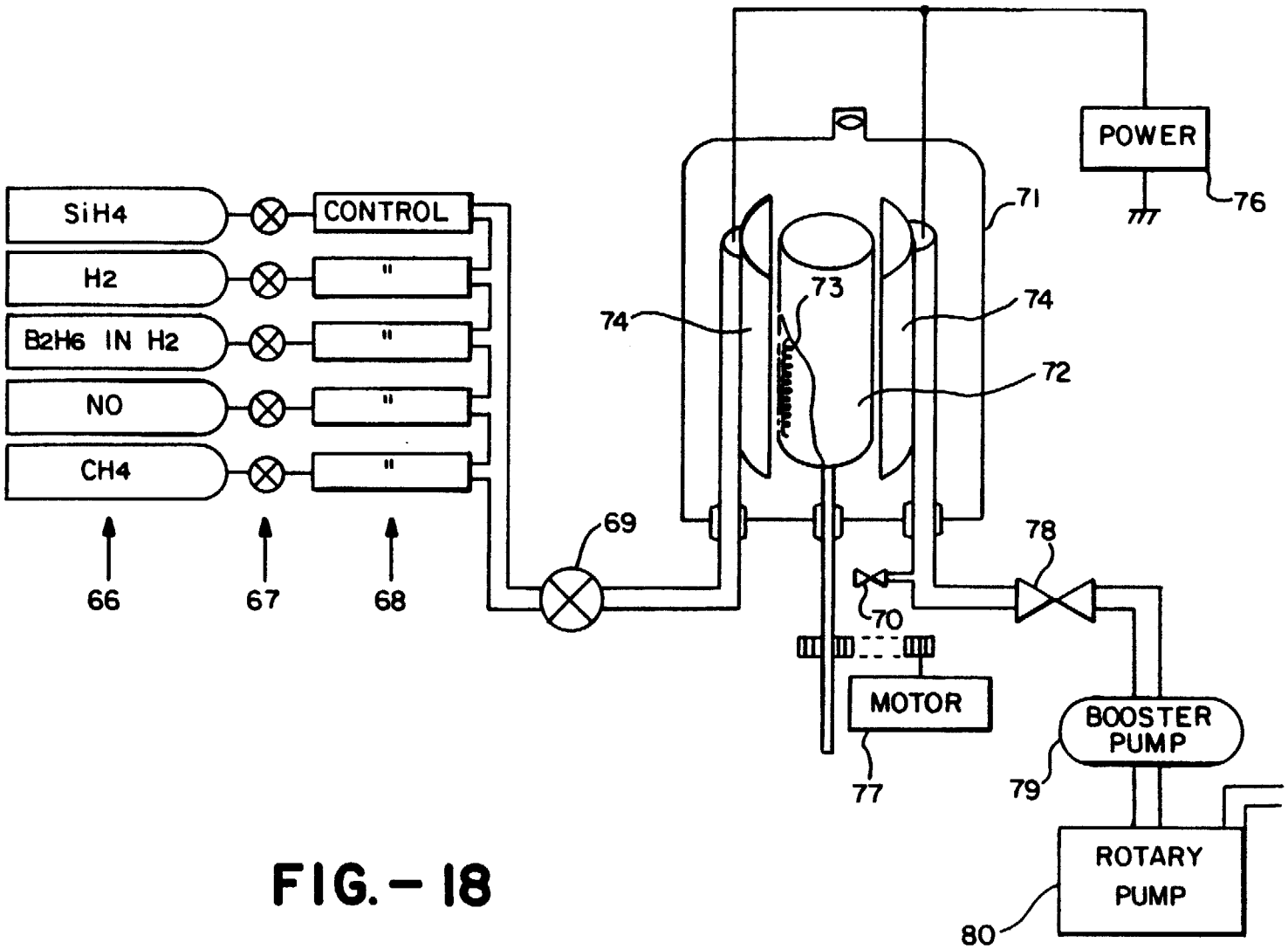
FIG. 18 is a schematic drawing of a plasma CVD apparatus for producing a photoreceptor of the type shown in FIG. 17, FIGS. 19 and 20 are graphs showing the relationship between the rate at which an amorphous silicon layer changes its electrical resistance when exposed to light and the mixing ratio of gases when the layer is formed by the apparatus of FIG. 18.

The amorphous silicon layers 61 and 62 are formed by a plasma CVD method as disclosed above. A plasma CVD apparatus which may be used for the purpose of this invention is schematically illustrated in FIG. 18 wherein numeral 71 indicates a reaction chamber in which the deposition reactions take place. A mechanical booster pump 79 and a rotary pump 80 are connected to the reaction chamber 71 through a valve 78 for creating a vacuum in the chamber 71. Numeral 70 indicates a leak valve. Inside the reaction chamber 71, there is a cylindrically shaped drum heater 73 on which an aluminum drum 72 to serve as the supporting member 63 of the photoreceptor of FIG. 17 is affixed. A motor 77 is connected to the shaft of the drum heater 73 such that the aluminum drum 72 affixed thereto can be rotated around its own axis. Electrodes 74 connected to a high-frequency power source 76 are disposed to flank the drum heater 73. The reaction chamber 71 is also connected to a pipe through which a source gas is introduced from high pressure gas containers 66. Each gas container 66 is provided with a valve 67 and a mass flow rate regulator 68. The source gas is introduced into the reaction chamber 71 by opening an inlet valve 69. The gas containers each contain $SiH_4$, $H_2$, $B_2H_6$ in $H_2$ (400 ppm of $B_2H_6$ mixed in $H_2$), NO and $CH_4$.

In order to form a photoreceptor shown in FIG. 17 with an apparatus thus structured, the surface of an aluminum drum to serve as the supporting member 63 is carefully cleaned with a supersonic cleaner and a vapor cleaner (not shown). The size of the drum is determined by the copier in which it is to be used but a drum of diameter about 100 mm and length about 340 mm is commonly used. Although the electroconductive supporting member 63 has frequently been described as being formed with an aluminum drum, it may be a cylindrical body with a different metallic material or made of an insulative material, such as a resin, coated with a conductive material. Moreover, it need not necessarily be shaped like a drum. It may alternatively be shaped like a sheet or a belt. For convenience of illustration, however, an aluminum drum is considered to be used as the supporting member.

After the aluminum drum 72 is cleaned and affixed to the drum heater 73, the valve 78 is opened to evacuate the interior of the reaction chamber 71 and the drum heater 73 is switched on. The drum heater 73 is controlled such that the surface temperature of the aluminum drum 72 is maintained at 250° C. Next, the gas inlet valve 69 is fully opened to introduce a source gas. Introduction of a desired source gas is achieved by opening only the desired ones of the valves 67 connected to the individual gas containers 66 and also by adjusting the individual mass flow rate regulators 68.

For forming the second amorphous silicon layer 62 (with composition of Si:H:B), the valves 67 of the containers 66 for $SiH_4$, $H_2$ and $B_2H_6$ are opened to introduce these gases. The flow rate regulators 68 are adjusted such that the volume ratio of $B_2H_6/SiH_4 = 10^{-5}$ is maintained. At the same time, the valve 78 of the exhaust system is adjusted such that the pressure inside the reaction chamber 71 is maintained at 1.5 torr. Next, the high-frequency power source 76 is switched on to apply a high-frequency voltage of 13.56 MHz and 400 W between the electrodes 74 to cause a glow discharge and an a-Si:H:B film is formed on the aluminum drum 72. If this is continued for about 40 minutes, an a-Si:H:B film of thickness about 5μm to serve as the second amorphous silicon layer 62 is formed. At this moment, the high-frequency power source 76 is switched off and the valves 69 and 67 are all closed to remove the source gas left inside the reaction chamber 71. After the leftover gas is completely removed from the interior of the reaction chamber 71, the next process of forming the first amorphous silicon layer 61 is started.

For forming the first amorphous silicon layer 61 (with composition of a-Si:H:B:N:O), the inlet valve 69 is fully opened again and then the valves 67 are selectively opened to introduce $SiH_4$, $H_2$, $B_2H_6$ and NO gases into the reaction chamber 71. At the same time, the mass flow rate regulators 68 are adjusted such that the individual flow rates of these gases are controlled and that the volume ratios of $B_2H_6/SiH_4 = 5\times10^{-4}$ and $NO/SiH_4 = 0.1$ can be maintained. The valve 78 of the exhaust system is again adjusted such that the pressure inside the reaction chamber 71 is maintained at 1.5 torr. Next, the high-frequency power source 76 is switched on to apply power of 400 W to start a glow discharge between the electrodes 74. After 25 minutes, an a-Si:H:B:N:O film of about 3μm in thickness to serve as the first amorphous silicon layer 61 is formed.

To further form the protective layer 64 after the formation of the amorphous silicon layers 61 and 62, the high-frequency power source 76 is switched off and the valves 69 and 67 are closed to once again evacuate the interior of the reaction chamber 71. Thereafter, a source gas for the protective layer 64 is introduced into the reaction chamber 71. For this purpose, the inlet valve 69 is fully opened again and $SiH_4$ and $CH_4$ are caused to flow into the reaction chamber 71. The $SiH_4$ flow rate is adjusted to 20sccm and the volume ratio $CH_4/SiH_4$ is maintained at 4.0–40 if a highly insulative protective layer is desired. If a protective layer with high photoconductivity is desired, the volume ratio may be controlled to 0.1–4.0. The pressure inside the reaction chamber is again controlled to remain at 1.5 torr. Next, the high-frequency power source 76 is switched on again to apply power of 400 W and after about 30 minutes of glow discharge between the electrodes 74, a protective layer of aSiC:H of about 0.5μm in thickness is formed. Thereafter, the high-frequency power source 76 is switched off, the valves 69 and 67 are closed and the valve 78 of the exhaust system is fully opened to produce a higher vacuum inside the reaction chamber 71. After the drum heater 73 is switched off, the produced photoreceptor is naturally cooled for about five hours.

Figure 19:
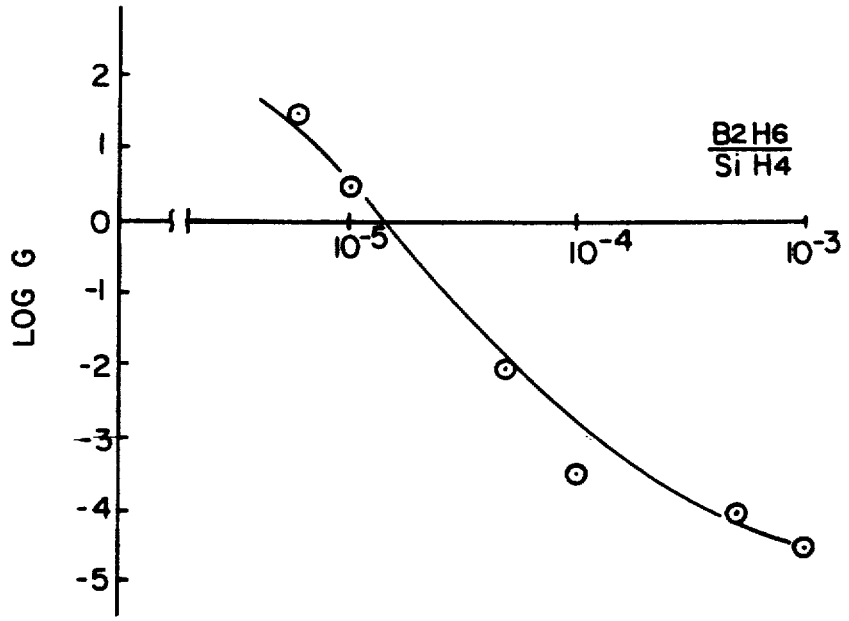
Figure 20:
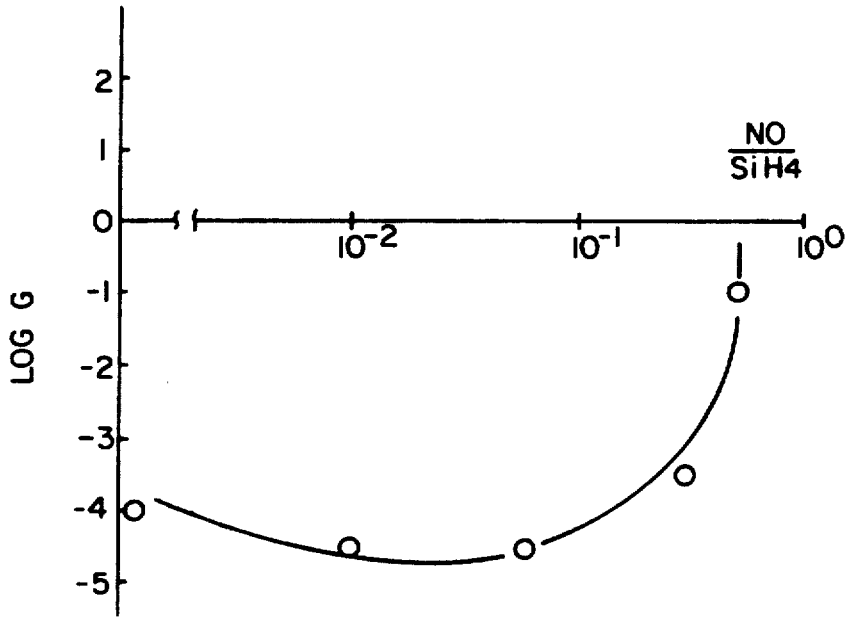

The method of producing an improved photoreceptor with two amorphous silicon layers described above in detail is also intended to be illustrative, and not limitative. Since the rate of change in electrical resistance by exposure to light is determined by the kind of source gas (that is, the kind of gas to be added to $SiH_4$ which is the principal constituent) and its flow rate, the composition of the source gas and its flow rate should be determined according to the desired photoconductive characteristics, or the fractional increase in electrical resistance upon exposure to light. For example, when an a-Si:H:B layer is formed with $SiH_4$, $H_2$ and $B_2H_6$ used in a source gas, the relationship between the volume ratio of the gases $B_2H_6/SiH_4$ and the logarithm of the fractional change (=G) in electrical resistance by exposure to light is as shown in FIG. 19. As another example, when an a-Si:H:B:N:O layer is formed with $SiH_4$, $H_2$, $B_2H_6$ and NO used in a source gas, the relationship between the volume ratio $NO/SiH_4$ and log G is as shown in FIG. 20 if the volume ratio $B_2H_6/SiH_4$ is set to $5\times10^{-4}$. FIG. 19 shows that the fractional change is very large in the range of $B_2H_6/SiH_4 = 10^{-4}$–$10^{-3}$, the absolute value of log G reaching 4 in this range. FIG. 20 shows a weaker dependency of G on the volume ratio and that the absolute value of log G is large if the volume ratio $NO/SiH_4$ is in the range of 0–0.3. In addition to the gases shown in FIG. 18, $PH_3$, $CH_4$, $O_2$, $N_2$, $NH_3$, etc. may be added in the source gas.

Figure 21:
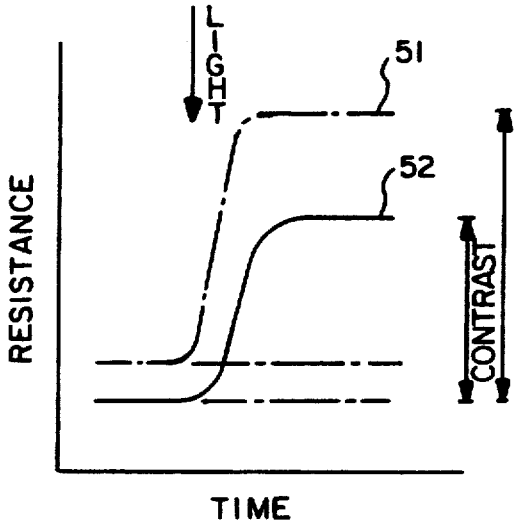
FIG. 21 is a graph showing the time-rate of change in electrical resistance of the amorphous silicon layer shown in FIG. 17.

If layers of amorphous silicon materials with high log G values (in absolute value) thus obtained are stacked as described above, a contrasty image can be obtained even with only a small amount of light energy. In other words, since a change in resistance occurs in a thin layer with a smaller amount of light energy than in a thick layer, if thin layers are stacked together, the characteristics of the individual layers help one another such that a very contrasty resistance image can be obtained even with a small amount of light energy. Let us now assume that the photoreceptor 11 of FIG. 6 has layer structure as shown in FIG. 17. When it is exposed to light, its amorphous silicon layers 61 and 62, each of which is a thin layer, increase their electrical resistance as shown in FIG. 21. Experiments have shown that exposure to a light beam of about 3 mWsec/cm$^2$ causes the electrical resistance of exposed areas to become greater than that of unexposed areas by a factor of about $10^3$–$10^4$ and therefore that a sufficiently contrasty image can be obtained by such an exposure. With a photoreceptor structured as shown in FIG. 5, by comparison, exposure to a light beam of 10–100 mWsec/cm$^2$ is required to increase the resistance of exposed areas to only about $10^2$–$10^3$ times greater than that of unexposed areas. In other words, if use is made of a photoreceptor of the type shown in FIG. 17, the rate of photoreceptor rotation need not be reduced to 1-2 rpm as disclosed above. Experiments have shown that an equally or more contrasty resistance image can be obtained with such a photoreceptor even if it is rotated at a faster rate of 5 rpm.

The foregoing description of the present invention has been presented for purposes of illustration and description through only a limited number of embodiments. The description is not intended to be exhaustive or to limit the invention to the precise form disclosed, and many modifications and variations are possible in light of the above teaching. Such modifications and variations that may be apparent to a person skilled in the art are intended to be included within the scope of this invention.

What is claimed is:

1. An image formation apparatus comprising a photoreceptor with an electroconductive supporting member and a photosensitive layer formed thereon, said photosensitive layer being characterized as changing electrical resistance thereof by exposure to light, an optical system which exposes said photosensitive layer to an image-carrying beam of light and thereby forms a resistance image by changing electrical resistance thereof, a charging device for forming an electrostatic image on said photosensitive layer according to said resistance image, a first bias voltage source so connected to apply a first bias voltage between said charging device and said photoconductive supporting member, a dielectric sheet for transferring thereonto said electrostatic image from said photosensitive layer, and a second bias voltage source for applying a second bias voltage between said dielectric sheet and said electroconductive supporting member to thereby cause said electrostatic image to be transferred from said photosensitive layer onto said dielectric sheet.

2. The apparatus of claim 1 further comprising a developing device for attaching toner onto said dielectric sheet to thereby convert said electrostatic image transferred onto said dielectric sheet into a visible toner image and an image transfer charging device for transferring said toner image from said dielectric sheet onto an image transfer medium brought into contact with said dielectric sheet.

3. The apparatus of claim 2 further comprising a charge erasing device for erasing said electrostatic image from said dielectric sheet after said toner image is transferred onto said transfer medium.

4. The apparatus of claim 2 further comprising rollers for transporting said dielectric sheet from a position opposite to said photosensitive layer to said developing device and from said developing device to said image transfer charging device.

5. The apparatus of claim 1 further comprising a heater disposed near said photoreceptor for annealing said photoreceptor to erase said resistance image after said electrostatic image is transferred onto said dielectric sheet.

6. The apparatus of claim 1 wherein said photosensitive layer increases electrical resistance thereof by exposure to light and is formed with a plurality of amorphous silicon layers each characterized as increasing electrical resistance thereof at a different rate by exposure to light.

* * * * *